US006877967B2

(12) United States Patent
Gantenhammer

(10) Patent No.: US 6,877,967 B2
(45) Date of Patent: Apr. 12, 2005

(54) ECCENTRIC SINGLE-ROTOR SCREW PUMP

(75) Inventor: Vinzenz Gantenhammer, Mühldorf/Inn (DE)

(73) Assignee: ViscoTec Pumpen-und Dosiertechnik GmbH, Toging a. IInn (DE)

( * ) Notice: Subject to any disclaimer, the term of this patent is extended or adjusted under 35 U.S.C. 154(b) by 0 days.

(21) Appl. No.: 10/123,543

(22) Filed: Apr. 16, 2002

(65) Prior Publication Data

US 2002/0192093 A1 Dec. 19, 2002

(30) Foreign Application Priority Data

Apr. 17, 2001 (DE) ..... 101 18 785

(51) Int. Cl.[7] ..... F01C 1/10
(52) U.S. Cl. ..... 418/48; 418/152; 417/205
(58) Field of Search ..... 418/48, 152, 205

(56) References Cited

U.S. PATENT DOCUMENTS 3,280,963 A * 10/1966 Kirker, Jr. ..... 415/72
5,085,564 A * 2/1992 Naylor et al. ..... 418/48
5,769,618 A * 6/1998 Ono et al. ..... 418/48

FOREIGN PATENT DOCUMENTS

| | | | | |
|---|---|---|---|---|
| DE | 6916941 | | 4/1969 | |
| DE | 2027 993 | | 12/1971 | |
| DE | 1703 009 | | 6/1972 | |
| DE | 2158 009 | | 5/1973 | |
| DE | 2316127 | A * | 10/1974 | ..... F04C/1/06 |
| DE | 2331585 | A * | 5/1975 | ..... F04C/1/06 |
| GB | 2084697 | A * | 4/1982 | ..... F16C/1/00 |
| JP | 10077974 | A * | 3/1998 | ..... F04C/2/107 |
| JP | 10180001 | A * | 7/1998 | ..... B01D/1/00 |
| JP | 2001140769 | A * | 5/2001 | ..... F04C/2/107 |

* cited by examiner

*Primary Examiner*—Theresa Trieu
(74) *Attorney, Agent, or Firm*—Greer, Burns & Crain, Ltd.

(57) ABSTRACT

The invention relates to an eccentric single-rotor screw pump (100) including a stator (102), and an eccentric screw (12) rotatably arranged within said stator (102) and which can be moved by a drive via a propeller shaft means (14) in the rotational direction, so that the stator (102) in cooperation with the eccentric screw (12) conveys a volume flow; and to a method for producing an eccentric single-rotor screw pump (100) and a propeller shaft means (14) for an eccentric single-rotor screw pump (100).

30 Claims, 4 Drawing Sheets

ECCENTRIC SINGLE-ROTOR SCREW PUMP

Figure 1:
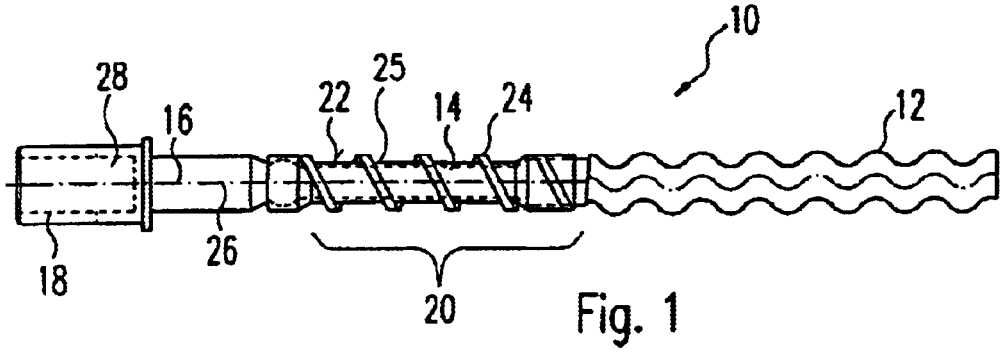

The invention relates to an eccentric single-rotor screw pump, a method for producing an eccentric single-rotor screw pump, and a method for producing a propeller shaft means for an eccentric single-rotor screw pump.

Eccentric single-rotor screw pumps, as well as methods for the production thereof, are already known in various configurations.

From the German laid-open document DE-OS-2 158 009, an eccentric single-rotor screw pump is known, including a rotor rotating in an elastic stator, and a universal shaft connecting the rotor with a propeller shaft. The rotor thereby is of a conical configuration and is received in a conically configured reception bore of the stator.

From the German laid-open document DE-OS-1 703 763, a screw pump is known, including a stator, a propeller shaft, and a clutch shaft equipped with a cardan joint, wherein the cardan joint has stopper faces delimiting the joint angle.

From the German laid-open document DE-OS-2 027 993, a joint is known, via which an eccentric screw of an eccentric single-rotor screw pump, which screw is rotatably supported on a stationary stator, can be connected with a propeller shaft. This joint has a concentrically traveling joint half connected with the propeller shaft, and a joint half connected with the eccentric screw. These joint halves are freely movable within the eccentricity.

The invention is based on the object of creating a differently configured eccentric single-rotor screw pump, a differently configured method for the production thereof, and a differently configured method for the production of a propeller shaft means for same.

According to a special aspect, the invention is based on the object of creating an eccentric single-rotor screw pump, a method for the production thereof, and a method for producing a propeller shaft means for same, which enable/s an improved pump output, and namely in particular also when the media to be delivered are highly viscous or charged with solid matters.

According to a special aspect, the invention is based on the object of creating an eccentric single-rotor screw pump, a method for the production thereof, and a method for producing a propeller shaft means for same, which enable/s an effective output, and which moreover can be produced and realized, respectively, in a cost-efficient manner.

The objective task is solved by an eccentric single-rotor screw pump according to claim 1 or according to claim 2 or according to claim 3.

The objective task is further solved by a method according to claim 24 or claim 25.

Preferred embodiments are the subject matter of the subclaims.

An eccentric single-rotor screw pump is in particular provided according to the invention, comprising a stator, an eccentric screw, a propeller shaft means, a drive and a housing.

The drive, in particular a motor such as an electric motor, can load the propeller shaft means, and namely in particular in the rotational direction. This propeller shaft means is coupled with the eccentric screw, so that the eccentric screw, as well, can be loaded in the rotational direction. The eccentric screw is received in the interior of a stator, and is arranged rotatably with respect to this stator. The propeller shaft means, viewed in the longitudinal direction, is preferably arranged axially displaced with respect to the eccentric screw. Through the interaction of the stator and the eccentric screw, a volume flow can be delivered and/or the pressure in a medium can be changed, both in a manner known per se.

Instead of a propeller shaft means, a propeller shaft will be talked about in the following. It is to be noted, however, that the invention is not intended to be hereby restricted, and that the propeller shaft in this meaning can be a shaft as such or a means comprising, for example, apart from the shaft, the bearing thereof.

The stator is configured elastic. It may, for example, be manufactured from an elastomer or a rubber or a synthetic material or any other material. The screw pump may be configured according to the type of a so-called mono-pump, as it is described in German Patent DE 1 703 763, or in any other way. The eccentric screw in particular comprises a single-flighted or multi-flighted screw or a single-thread or multi-thread. The stator, as well, comprises a single-thread or multi-thread, or a single-flighted or multi-flighted screw. The number of the turns of the thread or the screw arranged on the stator, preferably differs from the number of turns of the thread or the screw arranged on the eccentric screw.

The stator and the eccentric screw may also be of a different configuration.

The propeller shaft means in the meaning of the present invention, is in particular different from the eccentric screw that cooperates with the stator.

It is in particular provided according to the invention that a housing portion extends about a portion of the drive shaft in the circumferential direction, and namely over a certain length viewed in the axial direction. Radially between this shaft portion and this housing portion, an interspace is provided in which conveying means are provided. Into this interspace, a medium fed in through a feed opening can be moved, and this medium can be moved out from this interspace through an entry cross-section of the eccentric screw-stator arrangement. The conveying means arranged in this interspace influence the movement of the medium. These conveying means preferably control or support the movement of the medium. Particularly preferred, the conveying means are configured in such a manner that deposits or the remaining of residues in this interspace is prevented or at least reduced.

The objective task is moreover solved by an eccentric single-rotor screw pump according to claim 2.

According to the invention, an eccentric single-rotor screw pump is in particular provided, including a stator, an eccentric screw movably arranged within this stator, a propeller shaft and a drive. The propeller shaft is able to transfer a rotational movement from the drive to the eccentric screw, and features at least one zone that is configured flexible or is manufactured from a flexible material. This flexible zone is in particular configured elastic. The flexible zone enables a compensation of the radial offset connected with the eccentric revolution of the eccentric screw. It is in particular provided that this propeller shaft has at least one zone essentially fixedly arranged in the radial direction, and a zone movably arranged in the radial direction, these two zones being coupled across at least one flexible zone or flexible elements, or the zone movable in the radial direction being configured flexible.

The flexible zone of the propeller shaft may be configured in the most diverse manner. The flexibility may in particular be achieved by the geometric configuration and/or the material and/or the interaction of components, or in any other way.

Preferably, the propeller shaft deforms at least zone-wise during the operation of the eccentric single-rotor screw pump, and namely in particular in the area of the flexible or elastic zone.

The objective task is moreover solved by an eccentric single-rotor screw pump according to claim 3.

According to the invention, an eccentric single-rotor screw pump is in particular provided, including a stator, and an eccentric screw rotatably arranged within this stator, a drive, which is able to cause a relative twisting between the eccentric screw and the stator, and a screw different from the eccentric screw, arranged between the drive and the eccentric screw.

Via this screw, a torque is transmitted, in particular during the operation of the eccentric screw pump, between the drive and the eccentric screw. Preferably, the screw furthermore acts as a conveying screw that at least supports the conveyance of the medium to be delivered from or by the pump.

Preferably, the screw comprises one or more walls which extend worm-shaped, the screw comprising at least one portion in which the screw wall ends situated radially inside and radially outside are exposed. Hereby, it is in particular provided that these screw walls situated radially inside and radially outside, are not fixedly coupled in this portion which—viewed in the axial direction—may extend over the entire length of the screw or over a part of this length, with components, such as, for example, a shaft, which extend—viewed in the axial direction—over a length corresponding to or being larger than the double, preferably the single, axial distance of adjacent turns of the screw. Particularly preferred, the screw is not fixedly coupled at these ends—at least section-wise—with components the main extension direction of which is arranged in the axial direction of the screw.

It is particularly preferred that the screw is free from couplings—at least over a portion extending in the axial direction—that fixedly connect the screw with a shaft, such as a solid shaft or hollow shaft.

In a preferred configuration, the screw is configured—at least section-wise—elastic or flexible or as an elastic or flexible element. It is particularly preferred that this flexible or elastic configuration relates also to the radial direction.

In a preferred embodiment, an offset in the radial direction between components adjacent to the screw can be compensated by means of the screw or by means of a screw portion. In particular, an offset can hereby be compensated, which is conditioned by the fact that at least one component of these adjacent components, such as the eccentric screw or a radially fixedly coupled component of the eccentric screw, executes an eccentric rotational movement.

Preferably, the screw extends about a channel-like zone situated radially inside and extending in the axial direction, which is free from materials or free from solid materials and/or in which essentially no components are arranged via which a torque is transferred between the drive and the eccentric screw.

It is particularly preferred that the screw, in its end zones lying opposite in the axial direction, is in each case coupled with components between which the screw is allowed to transfer a load such as a torque. These components may axially border the screw, and may be coupled, in particular for joint rotation with same, or may overlap with the screw in the axial direction in the end zone of same. Such a component may, for example, be configured as a shaft extending into an axial end portion of the screw, and namely lying in particular radially inside or radially outside, and being coupled with the screw.

It is particularly preferred that the screw is connected in a first of its end zones with a first portion of a propeller shaft means, and in the second of these end zones with a second portion of a propeller shaft means or with the eccentric screw.

The first portion of the propeller shaft means is in particular provided between the screw and the drive. The second portion of the propeller shaft means is in particular arranged between the screw and the eccentric screw. Hence, it is in particular provided that the second screw end portion facing the eccentric screw, in this preferred configuration, is directly connected or via at least one interconnected component with the eccentric screw.

Preferably, radial protrusions are provided on the propeller shaft, which extend from the outer circumference of a propeller shaft portion also at least in the radial direction. The term "radial protrusions" in the meaning of the present invention, has to be understood in a broad manner. In particular, a zone has to be understood by a radial protrusion, which extends in the radial direction and which extends at least section-wise at an angle to the plane stretched by the circumferential direction. These radial protrusions may be configured single-piece or multi-piece. Preferably, a radial protrusion configured as a single-flighted or multi-flighted screw extends on the outer surface of at least one propeller shaft portion. This screw is preferably wound about the longitudinal axis of the propeller shaft portion. The screw is configured single-piece or multi-piece.

The radially extending protrusions preferably are configured paddle-shaped or fan-shaped or rotor blade-like. The protrusions radially extending on the propeller shaft, and the screw, respectively, are not associated to the eccentric screw and the stator, respectively, surrounding this eccentric screw, but are different from possible screw-shaped configurations or zones of these components. Hereby, however, it is not intended to be excluded that the protrusions extending on the propeller shaft in the radial direction or the propeller shaft portions about which the protrusions and the screw, respectively, are arranged, can be eccentrically moved. Such an eccentric movement may in particular be given with a propeller shaft having flexible zones. However, it is also preferred that these radially extending protrusions, respectively this screw, respectively the propeller shaft portion associated to same, are moved non-eccentrically.

Without intending to hereby restrict the invention, a screw will be discussed in the following, and to a large extent also in the claims, whereby the term screw thereby literally means one or more radial protrusions and/or a screw.

The screw that acts or is configured in particular as a conveying means, preferably influences and supports, respectively, or controls the movement of a medium fed to the arrangement of eccentric screw pump and rotor.

Preferably, the screw is manufactured of a synthetic material, in particular of rubber or such like, or of natural rubber.

It is particularly preferred that a housing portion surrounding at least a part of the propeller shaft, and namely in particular a propeller shaft portion on which a screw is arranged, comprises a cylindrical inner surface.

It is particularly preferred that this cylindrical inner surface has a constant inner diameter. The respective housing portion, however, may also be configured conical or in any other way.

The screw arranged on the propeller shaft preferably is connected non-rotatably and/or axially stationary with a propeller shaft portion.

Preferably, the screw is configured and arranged in such a manner that the movement path of the screw zones arranged radially outside, essentially is adapted to the inner dimension of the housing portion surrounding this screw in the respective zone. This adaptation can in particular be caused by the dimensions and/or the material of the screw. Particularly preferred, the radially outer zones of the screw which is arranged on the propeller shaft, are in contact with the housing portion surrounding this screw. Yet, it is also preferred that a play is provided in the radial direction between the screw and this housing. According to a preferred configuration, the screw abuts against this housing portion arranged radially outside under a kind of spring action.

Preferably, the screw provided on the propeller shaft, viewed in the axial direction, is arranged between a feed opening and the eccentric screw. Through this feed opening, the medium to be in particular delivered by the eccentric single-rotor screw pump, which medium is in particular highly viscous and/or charged with solid matters, is filled in. If the case may be, the screw is, viewed in the axial direction of the propeller shaft, also arranged in the zone of the feed opening. Preferably, the medium fed in through the feed opening is moved during the operation passing through the screw towards the eccentric screw and the arrangement of eccentric screw and stator, respectively.

The screw arranged on the propeller shaft extends in a particularly preferred manner, viewed in the axial direction, over at least one quarter of the distance corresponding to the spacing between, viewed in the axial direction, the end of the feed opening facing the eccentric screw, for one, and the end of the eccentric screw facing this feed opening, for another. Particularly preferred, the screw arranged on the propeller shaft extends over at least one third, preferably over at least the half, particularly preferred over at least two thirds, particularly preferred over at least 80%, particularly preferred over at least 90% or more of this distance.

Preferably, this screw provided on the propeller shaft actually is configured as a screw, and comprises more than one, preferably at least two or at least three or at least four or at least five turns.

In a preferred embodiment, the screw arranged on the propeller shaft comprises zones radially inside extending in the axial direction and/or in the circumferential direction of this propeller shaft. Through these zones, the screw supports against the propeller shaft, if the case may be. Particularly preferred, a coating or a coat or a covering is provided in the zone in which the screw is provided, whereby the zones of the screw lying inside, which extend into the circumferential direction and/or in the axial direction, are covered radially outside by this cover or coating.

It is also preferred that, without zones being arranged radially inside on the screw and extending in the axial or in the circumferential direction, the propeller shaft, at least in a shaft portion, is provided with a coating or is coated, or is provided with a cover. Particularly preferred, a coating vulcanized onto the propeller shaft or a propeller shaft portion is provided.

Preferably, the screw arranged on the propeller shaft is connected with this shaft during or by means of the coating or covering of this propeller shaft.

Preferably, the screw is non-rotationally and/or axially stationary connected with the propeller shaft.

The screw is implemented in a preferred manner at least in part in the coating or covering of the propeller shaft.

It is particularly preferred that the covering or coating of the propeller shaft is manufactured of a synthetic material or of rubber or such like, and preferably has at least also a protective function.

It is preferred that the propeller shaft has exactly one, at least coherent element which is configured flexible, whereby via this flexible element, a torque may be transmitted from the drive to the eccentric screw, if the case may be. This element may be configured one-piece or multi-piece.

According to an alternative preferred configuration, the propeller shaft comprises several flexible elements, if necessary, interconnected by rigid coupling means. If necessary, a torque may be transmitted from the drive to the eccentric screw.

Preferably, the coupling means furthermore enable a compensation in the longitudinal direction. It is further preferred that in another place, a longitudinal compensation of the propeller shaft is enabled by corresponding means, or that no means is provided for the compensation in the longitudinal direction.

In a preferred embodiment, the propeller shaft has a flexible bearing, via which it supports. This bearing is flexible, in particular in the radial direction. Particularly preferred, two or more bearings flexible in the radial direction are provided. Preferably, a propeller shaft, configured rigid, if necessary, is connected, for one, via a flexible bearing with the eccentric screw and, for another, via a flexible bearing with the drive.

It has to be noted that the screw in the meaning of the present invention can be differently configured and arranged. In particular, a screw can be configured in such a manner that a load or a torque is transmitted via this screw or a portion of this screw between the drive and the eccentric screw without a load such as a torque being transmitted via components connected in parallel, such as a shaft, between the drive and the eccentric screw; the screw can in particular be also configured and arranged in such a manner that a load such as a torque, which is transmitted from the drive to the eccentric screw, essentially is not guided across this screw; it is further preferred that the screw is configured and arranged in such a manner that at least in a portion of the screw, a part of a load such as a torque which is transmitted from the drive to the eccentric screw, is guided across this screw or a portion of this screw. In this latter exemplary configuration, it can in particular be provided that another part of this load or of this torque is transmitted via a component such as a propeller shaft, which is connected in parallel to this portion of the screw as far as the action is concerned.

This respectively mentioned portion can extend over the entire screw or over a part of this screw, and namely in particular viewed in the axial direction.

The screw in the meaning of the present invention, is a part of the propeller shaft means or is different from the propeller shaft means.

The objective task is further solved by a method according to claim 24.

The objective task is further solved by a method according to claim 25.

According to the invention, it is in particular provided that a shaft body, hence in particular a propeller shaft body, is produced, as well as a screw. Subsequently, this shaft body and this screw are placed into a mould. In a preferred embodiment, the shaft body and the screw are placed into different mould halves of a mould. Subsequently, the mould is closed, and a corresponding coating means is introduced into the mould, which coats the shaft body, whereby, if necessary concurrently, the screw is connected with the shaft body. It is also preferred that the screw is previously fixed to the shaft body. The screw is in particular implemented, at least in part, in the coating of the shaft body.

The invention is not intended to be restricted by the exemplary and preferred embodiments and configurations.

Figure 2:
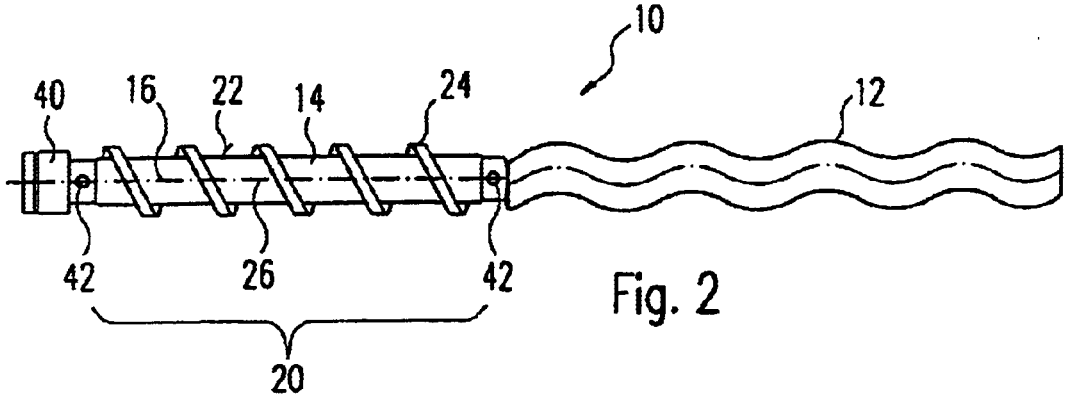
Figure 3:
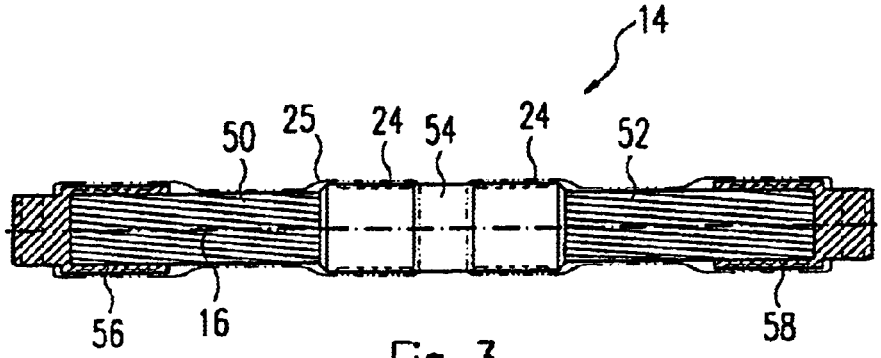
Figure 4:
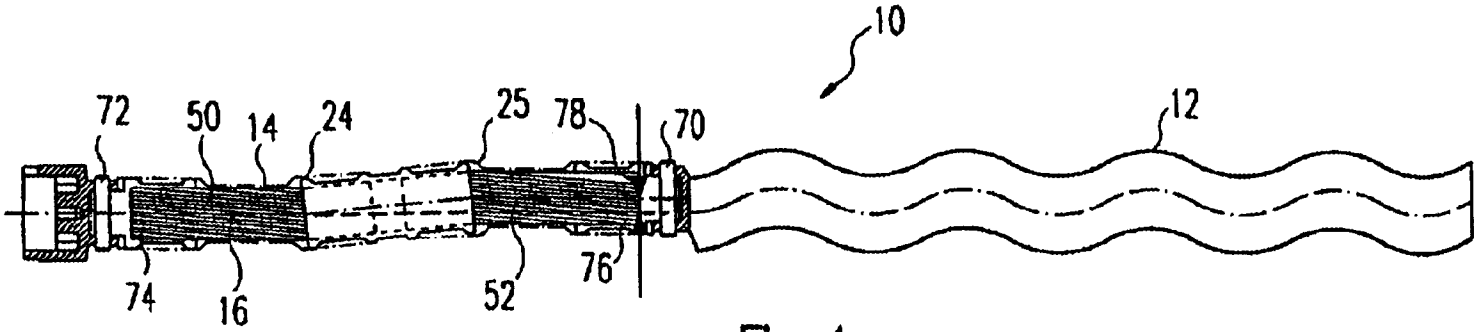
Figure 5:
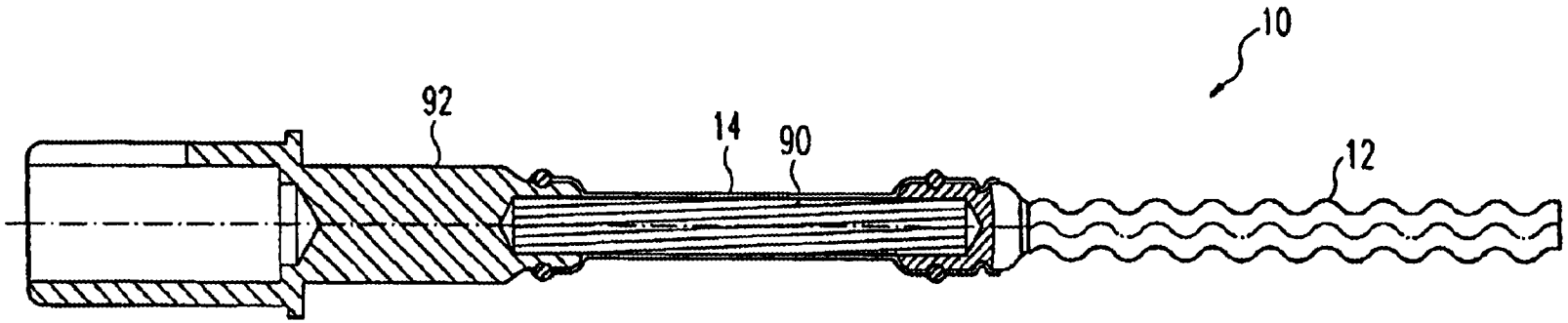
Figure 6:
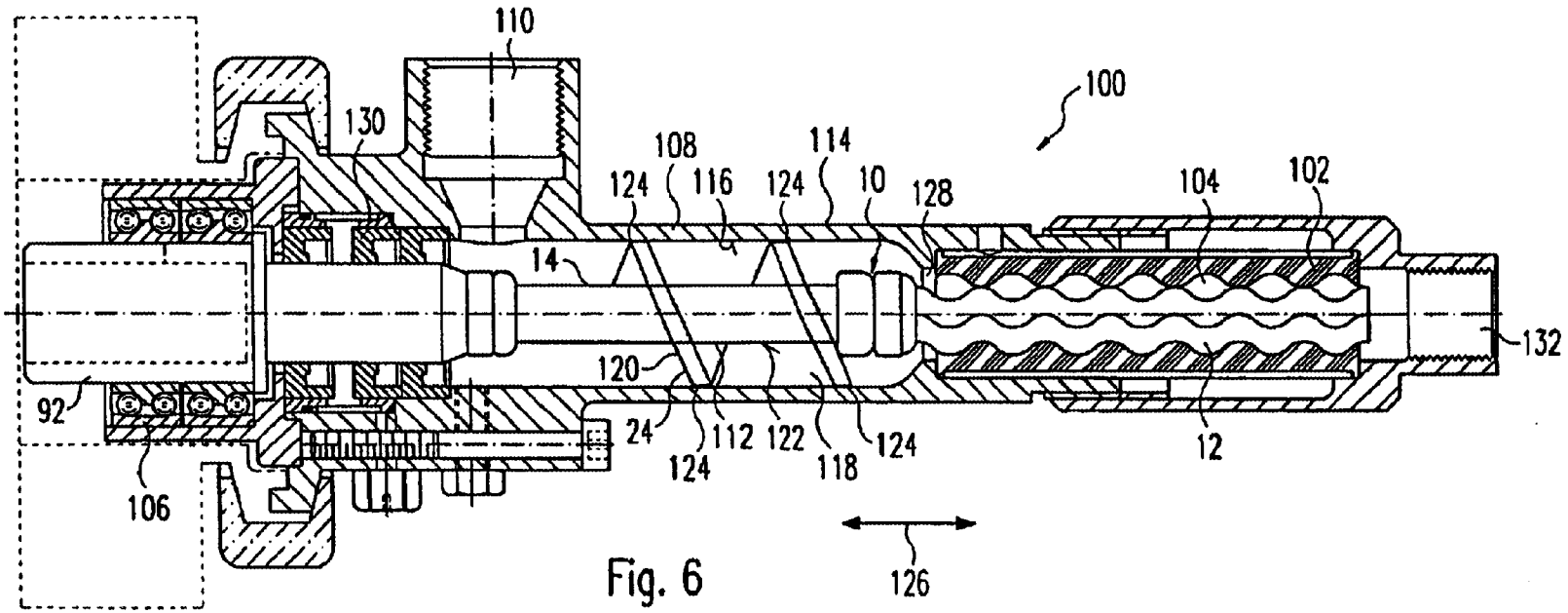
Figure 7:
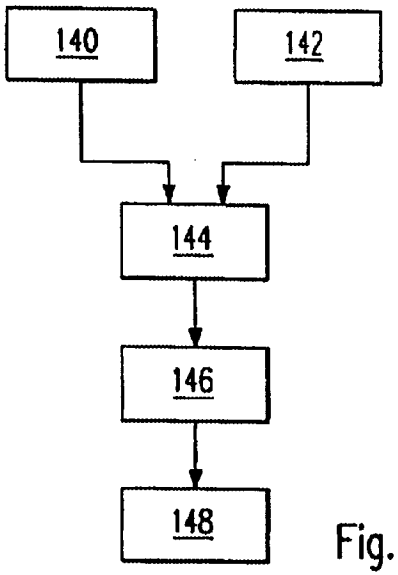

Aspects of the invention will be described in the following by means of the Figures, without intending the invention to be hereby restricted. Therein shows:

FIG. 1 a first exemplary embodiment of the invention in a schematic partial representation;

FIG. 2 a second exemplary embodiment of the invention in a schematic partial representation;

FIG. 3 a third exemplary embodiment of the invention in a schematic partial representation;

FIG. 4 a fourth exemplary embodiment of the invention in a schematic partial representation;

FIG. 5 a fifth exemplary embodiment of the invention in a schematic partial representation;

FIG. 6 a sixth exemplary embodiment of the invention in a schematic partial representation;

FIG. 7 the exemplary course of an inventive method; and

Figure 8:
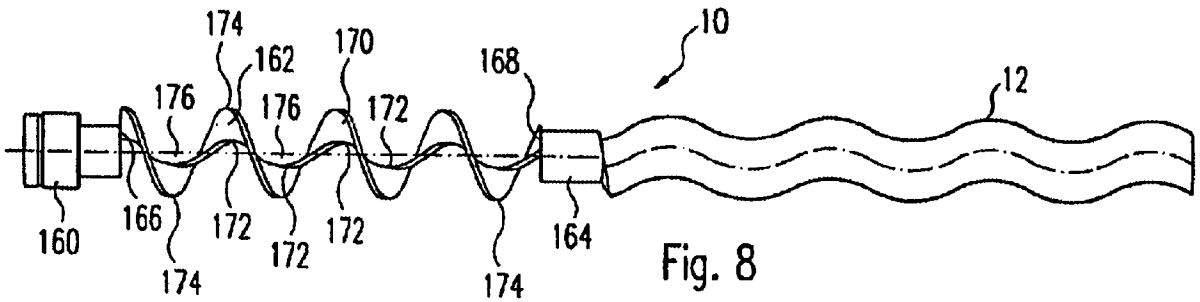

FIG. 8 a seventh exemplary embodiment of the invention in a schematic partial representation.

FIG. 1 shows a first exemplary embodiment of the invention in a schematic partial representation.

In FIG. 1, a rotor assembly 10 is shown having an eccentric screw 12 and a propeller shaft 14. The eccentric screw 12 is connected with the propeller shaft 14, and the propeller shaft 14 can be connected, in a manner not shown in FIG. 1, with a drive not shown.

The eccentric screw 12 is arranged offset from this propeller shaft 14 in the longitudinal direction of same outlined by the dashed line 16, or adjoins this propeller shaft 14 in the longitudinal direction.

Propeller shaft 14 has a connection zone 18 to which a drive or a suitable intermediate means can be connected.

Propeller shaft 14 has a shaft portion 20, which on the outer surface 22 thereof, a second screw 24 is provided and is, if the case may be, at least in part implemented in a coating 25.

This second screw 24 extends about the longitudinal axis of this shaft portion 20 or this propeller shaft 14. In the representation as per FIG. 1, this second screw 24 essentially has four and a half turns. This second screw 24 extends (at least also) in the radial direction from the outer surface 22 of propeller shaft 14 or the shaft portion 20.

In the configuration as per FIG. 1, propeller shaft 14 is configured as a non-releasable unit and is further connected with the eccentric screw 12 in a non-releasable manner.

The connection zone 18 is configured hollow-cylindrical and has an inner zone 28, in which a shaft end of the drive or of an intermediate means can be received.

FIG. 2 shows another exemplary embodiment of the invention in a partial schematic representation.

The embodiment as per FIG. 2 differs from the embodiment as per FIG. 1 essentially in that the shaft portion of the propeller shaft 14 is connected with the eccentric screw 12 in a releasable manner, and is connected, if the case may be, with a connection piece 40. For this purpose, appropriate releasable connection means 42 are provided, which are schematically outlined in FIG. 2.

The shaft portion 20, on which the screw 24 is arranged, in the configurations as per FIGS. 1 and 2, is configured, if appropriate, flexible or elastic, and namely in particular in such a manner that a (flexible or elastic) mobility is given in the radial direction.

Such a flexible elastic zone, and this applies in particular also to other configuration of the invention, can in particular be configured in such a manner that a steel rope or a kind of steel rope is wound in several layers, e.g. in five or six layers (seen in FIGS. 3 and 4, flexible shaft portions 50, 52). Other materials or configurations are also preferred.

FIG. 3 shows an exemplary partially illustrated embodiment of the invention in a schematic representation.

FIG. 3 shows in particular a propeller shaft 14 or a part of a propeller shaft 14 having a first flexible shaft portion 50, and a second flexible shaft portion 52 spaced apart from the first shaft portion 50 in the longitudinal direction 16. In the longitudinal direction 16, an essentially rigid intermediate piece 54 is arranged between the first shaft portion 50 and the second shaft portion 52, which intermediate piece 54 is connected, for one, with the shaft portion 50 and, for another, with the shaft portion 52.

The flexible configuration of the shaft portions 50, 52 is in particular such that, insofar as these are in each case fixedly clamped in the radial direction, the other end can be deflected in the radial direction.

The first shaft portion 50 and the second shaft portion 52 is received at an end in each case facing away from the other shaft portion 50, 52, in a reception means 56 or 58. Through this reception means 56, 58, that part of the propeller shaft 14 or the shaft 14, for one, can be coupled with the drive and, for another with an eccentric screw 12.

FIG. 4 shows an exemplary rotor assembly of an eccentric screw pump in a schematic partial view.

In FIG. 4, the propeller shaft 14 in particular described by means of FIG. 3, is illustrated in a deflected position. Moreover, an eccentric screw 12 is illustrated in FIG. 4 offset into the longitudinal direction 16 and connected to the propeller shaft by suitable and releasable fastening means 70.

The propeller shaft 14, at the end facing away from the eccentric screw 12, is connected with an intermediate piece 73 or adapter or such like by suitable, in particular releasable fastening means 72, by means of which intermediate piece 73 or adapter, a connection with a drive can be realized. If the case may be, the propeller shaft 14 directly engages into the drive, what is not shown in FIG. 4.

As can be seen from FIG. 4, the end portions 74, 76 of the propeller shaft 14 as compared to the representation as per FIG. 3, are arranged mutually staggered, what is also illustrated by the arrow 78.

This is in particular enabled by the flexible configuration of the propeller shaft 14.

When the end portion 74 of the flexible shaft portion 50 facing away from the eccentric screw 12, is acted upon with a torque at an essentially constant radial position, then it is enabled that the end portion of the propeller shaft 14 facing the eccentric screw 12, rotates eccentrically, so that the eccentricity of this eccentric screw 12 can be compensated by means of the propeller shaft 14, which means in particular that a torque can be transferred from a radially fixed portion to a radially variable portion.

If appropriate, a screw 24 and/or a coating 25 in the configurations as per FIGS. 3 and 4 is provided on the outer surface of the propeller shaft 14.

FIG. 5 shows an exemplary embodiment of a rotor assembly 10 of an eccentric single-rotor screw pump in a schematic partial view.

Staggered from an eccentric screw 12 in the longitudinal direction and connected with same, a propeller shaft 14 is provided. This propeller shaft 14 has exactly one coherent shaft portion 90 that is configured flexible, so that the opposite ends thereof can be moved in the radial direction relative to each other. This shaft portion 90 is arranged between the eccentric screw and a connection piece 92 by means of which the propeller shaft 14 can be connected with a drive.

Via the flexible shaft portion 90, a torque can be transferred between the drive not shown and the eccentric screw 12.

FIG. 6 shows an exemplary embodiment of the invention in a schematic partial view.

In FIG. 6, an eccentric single-rotor screw pump 100 is in particular shown having an eccentric screw 12 and a stator 102. The stator 102 has an inner space 104 in which the eccentric screw 12 is received.

The eccentric screw 12 is connected with a propeller shaft 14 which can be acted upon by a drive via a connection piece 92.

The propeller shaft 14 or the connection piece 92 is mounted by suitable bearing means 106.

Moreover, a housing 108 is provided receiving the stator 102.

This housing 108 has a feed opening 110 through which a medium can be filled in. The propeller shaft 14 has a shaft portion 112 surrounded by a housing portion 114 having a cylindrical inner wall 116.

An interspace 118 is provided in the radial direction between this housing portion 114 and the shaft portion 112.

Conveying means 120 configured as a screw 24, are provided in this interspace 118.

This screw 24 extends from the outer surface 122 of the shaft portion 112 at least also in the radial direction, and essentially abuts with its zone 124 arranged radially outside against the cylindrical inner wall 116 of the housing portion 114. The screw 24 is connected with a shaft portion 112 and is arranged rotatably relative to the housing portion 114 or the housing 108.

The shaft portion 112 bearing the screw 24 is arranged, viewed in the axial direction which is indicated by double arrow 126, between the feed opening 110 and the eccentric screw 12.

A medium fed in through the feed opening 110 is moved through the interspace 118, in particular also by means of screw 24 co-rotating with the propeller shaft 14, to the entry cross-section 128 of the eccentric screw-stator arrangement.

The entry cross-section 128 has a smaller cross-sectional surface than the interspace 118, which extends in the zone of screw 24. If appropriate, suitable sealing means 130 are provided.

Preferably, the propeller means is in part configured flexible. In particular, the shaft portion 112 is configured flexible.

After having been moved through the eccentric screw-stator arrangement, the medium exits through the exit opening 132, the cross-sectional surface of which is larger than the entry cross-section 128.

FIG. 7 shows the steps of an exemplary inventive method.

In step 140, a shaft body is manufactured, and in step 142, a screw is manufactured.

The shaft body as well as the screw subsequently are placed into a mould (step 144), and namely into a separate mould half.

In step 146, the mould is closed.

In step 148, a coating material such as rubber or a synthetic material is filled into the mould, which causes the shaft body to become coated and at least a part of the screw being thereby implemented into this coat.

FIG. 8 shows an exemplary embodiment of the invention in a schematic partial representation.

In FIG. 8, an exemplary embodiment of a rotor assembly 10 or a portion of a rotor assembly 10 is in particular shown, which can, for example, be given, as also the rotor assemblies 10 or propeller shaft 14 illustrated in the FIGS. 1 through 5, in the exemplary eccentric single-rotor screw pump 100 as per FIG. 6, and which can replace at least in part the rotor assembly 10 shown in FIG. 6 or the propeller shaft shown in FIG. 6.

The rotor assembly 10 as per FIG. 8 has an eccentric screw 12, a first propeller shaft portion 160 and a screw 162.

Moreover, the rotor assembly 10 as per FIG. 8 has a second portion 164 which can be associated to or is associated to a propeller shaft means or the eccentric screw 12.

The screw 162 is made of iron or steel or any other material, and is preferably coated.

At a first end 166 situated in the axial direction, the screw 162 is coupled with the first propeller shaft portion 160, and namely in particular fixedly, such as non-movable in the radial and/or axial direction.

At a second end 168 facing away from the first end 166 in the axial direction, the screw 162 is coupled with a second portion 164, and namely fixedly, such as non-movable in the radial and/or axial direction. The second portion 164 insofar as it is—according to a preferred configuration—not associated to the eccentric screw 12, is coupled with same.

The screw 162 has a screw wall 170 with ends 172 lying radially inside and ends 174 lying radially outside.

The ends 172 lying radially inside and the ends 174 lying radially outside of the screw wall 170 or of the screw 162 in each case are free ends.

Radially within the ends 172 lying radially inside of the screw wall 170 or the screw 162, a zone 176 is provided extending in the axial and radial direction, into which the screw essentially does not extend, and which is essentially free from components that are fixedly coupled with the screw. This zone 176 is in particular configured cylindrical.

When the first propeller shaft portion 160 of the rotor assembly 10 is acted upon by a drive not shown, and namely is in particular acted upon with a torque, then this torque is transmitted from the screw 162 to the second portion 164 or the eccentric screw 12.

In operation, hence in particular when the rotor assembly 10 is mounted in an eccentric single-rotor screw pump and same conveys a medium, then the eccentric screw 12 rotates eccentrically. The radial displacement hereby given relative to the first propeller shaft portion, is compensated by the screw 162. If necessary, the screw 162 moreover compensates an axial displacement.

| Reference numerals | |
|---|---|
| 10 | rotor assembly |
| 12 | eccentric screw |
| 14 | propeller shaft |
| 16 | dashed line |
| 18 | connection zone |
| 20 | shaft portion of 14 |
| 22 | outer surface of 20 |
| 24 | screw |
| 25 | coating of 14 |
| 26 | longitudinal axis of shaft portion 20 |
| 28 | inner zone |
| 40 | connection piece |
| 42 | releasable connection means |
| 50 | first flexible shaft portion |
| 52 | second flexible shaft portion |
| 54 | intermediate piece |
| 56 | reception means |
| 58 | reception means |
| 70 | fastening means |
| 72 | fastening means |
| 73 | intermediate piece or adapter |
| 74 | end portion |
| 76 | end portion |
| 78 | arrow |
| 90 | coherent flexible shaft portion |
| 92 | connection piece |
| 100 | eccentric single-rotor screw pump |

-continued

| Reference numerals | |
|---|---|
| 102 | stator |
| 104 | inner space of the stator |
| 106 | bearing means |
| 108 | housing |
| 110 | feed opening |
| 112 | shaft portion of 14 |
| 114 | housing portion |
| 116 | cylindrical inner wall |
| 118 | interspace |
| 120 | conveying means |
| 122 | outer surface of 112 |
| 124 | zone of 24 arranged radially outside |
| 126 | double arrow |
| 128 | entry cross-section |
| 130 | sealing means |
| 140 | step |
| 142 | step |
| 144 | step |
| 146 | step |
| 148 | step |
| 160 | first propeller shaft portion |
| 162 | screw |
| 164 | second portion |
| 166 | first axial end of 162 |
| 168 | second axial end of 162 |
| 170 | screw wall |
| 172 | end of 170 situated radially inside |
| 174 | end of 170 situated radially outside |
| 176 | zone |

What is claimed is:

1. An eccentric single-rotor screw pump comprising:

a stator;

an eccentric screw rotatably arranged within said stator movable by a drive in a rotational direction via a propeller shaft; and a housing having a housing portion surrounding at least a part of the propeller shaft in a circumferential direction, and at least an interspace being provided radially between said housing portion and at least a part of the propeller shaft, into which said interspace a medium fed in through a feed opening is movable, and out of which said medium is movable to an entry cross-section of the eccentric screw-stator arrangement, in the zone of the interspace, at least a means for conveying the medium is provided to influence the movement of the medium from the feed opening to the entry cross-section of the eccentric screw-stator arrangement, with the propeller shaft being at least in part provided with a coating or a cover in a zone of a shaft portion of a screw;

a radial inside portion of said screw has at least one zone extending relative to the propeller shaft in an axial direction and/or a circumferential direction, and via which said screw supports the propeller shaft; and whereby said at least one zone of the screw lying inside, which extends into at least one of the circumferential direction and the axial direction, is covered radially outside by said cover or coating.

2. The eccentric single-rotor screw pump according to claim 1, wherein said propeller shaft has at least a flexible zone so that the propeller shaft transfers a rotational movement from the drive to the eccentric screw and thereby compensates a radial offset conditioned by an eccentric course of the eccentric screw, whereby the propeller shaft deforms.

3. The eccentric single-rotor screw pump according to claim 1, characterized in that on the propeller shaft radial protrusions are provided which extend from an outer surface of a shaft portion at least also in the radial direction.

4. The eccentric single-rotor screw pump according to claim 1, characterized in that a screw extends on at least one portion of an outer surface of the propeller shaft, and is wound about a longitudinal axis of the propeller shaft.

5. The eccentric single-rotor screw pump according to claim 1, characterized in that the screw is made of a synthetic material.

6. The eccentric single-rotor screw pump according to claim 1, characterized in that the housing portion surrounding at least a part of the propeller shaft has at least a cylindrical surface when viewed in section.

7. The eccentric single-rotor screw pump according to claim 1, characterized in that the housing portion surrounding at least a part of the propeller shaft has at least a constant diameter when viewed in section.

8. The eccentric single-rotor screw pump according to claim 1, characterized in that the arrangement and/or configuration of zones of the screw, which are arranged radially outside, are essentially adapted to inner dimensions and/or a contour of the housing portion surrounding the propeller shaft.

9. The eccentric single-rotor screw pump according to claim 1, characterized in that zones of the screw arranged radially outside essentially contact the inner surface of the housing portion surrounding the propeller shaft.

10. The eccentric single-rotor screw pump according to claim 1, characterized in that the screw, viewed in the longitudinal direction of the propeller shaft, is essentially arranged between the feed opening and the eccentric screw.

11. The eccentric single-rotor screw pump according to claim 1, characterized in that the screw, viewed in the longitudinal direction of the propeller shaft, essentially extends up to the eccentric screw.

12. The eccentric single-rotor screw pump according to claim 1, characterized in that a second screw is connected during the coating and/or covering of a shaft portion with said shaft portion.

13. The eccentric single-rotor screw pump according to claim 1, characterized in that a second screw is implemented in the coating or cover of the propeller shaft.

14. The eccentric single-rotor screw pump according to claim 1, wherein the screw is made of rubber.

15. An eccentric single-rotor screw pump comprising:

a stator;

an eccentric screw rotatably arranged within said stator;

a propeller shaft connected with the eccentric screw; and a drive configured for causing a relative twisting between the eccentric screw and the stator, the eccentric screw rotating eccentrically, and wherein said propeller shall has at least a flexible zone so that the propeller shaft can transfer a rotational movement from the drive to the eccentric screw and thereby compensate a radial offset conditioned by an eccentric course of the eccentric screw, whereby the propeller shaft deforms and has a coating vulcanized onto the shaft.

16. The eccentric single-rotor screw pump according to claim 15, characterized in that the propeller shaft has exactly one at least coherent element, which is configured flexible, whereby via said flexible element, a torque can be transferred from a drive to the eccentric screw.

17. The eccentric single-rotor screw pump according to claim 15, characterized in that the propeller shaft has a plurality of elements interconnected via rigid coupling, via which elements a torque can be transferred from a drive to the eccentric screw.

18. The eccentric single-rotor screw pump according to claim 15, characterized in that the propeller shaft has at least a flexible bearing, said bearing being flexible in the radial direction.

19. The eccentric single-rotor screw pump according to claim 15, further including between the drive and the eccentric screw, a screw different from the eccentric screw is arranged, via which a load transferred from the drive to the eccentric screw is transferred.

20. An eccentric single-rotor screw pump comprising: a stator, an eccentric screw rotatably arranged within said stator, and a drive configured for causing a relative rotation between the eccentric screw and the stator, the eccentric screw rotating eccentrically, between the drive and the eccentric screw, a second screw different from the eccentric screw is arranged, via which a load transferred from the drive to the eccentric screw is transferred;

whereby the second screw has one or more walls extending worm-shaped, the second screw having at least one portion, in which ends lying radially inside of a screw wall and ends lying radially outside of the screw wall are exposed.

21. The eccentric single-rotor screw pump according to claim 20, characterized in that the second screw has two end zones situated in an axial direction at opposite ends, a first of said end zones being connected with a first portion of a propeller shaft, via which a load is transferred from the drive to the eccentric screw, and a second of said end zones being connected with a second portion of the propeller shaft, the first portion of the propeller shaft being arranged between the drive and the screw, and the second portion of the propeller shaft being arranged between the second screw and the eccentric screw.

22. The eccentric single-rotor screw pump according to claim 20, characterized in that a load transferred between the drive and the eccentric screw is transferred via the second screw, and that the second screw is configured for causing a radial compensation between the drive and the eccentric screw.

23. The eccentric single-rotor screw pump according to claim 20, characterized in that the screw is made of a synthetic material.

24. The eccentric single-rotor screw pump according to claim 20, characterized in that the arrangement and/or configuration of zones of the screw, which are arranged radially outside, are essentially corresponding to the inner dimensions and/or contour of the housing portion surrounding the propeller shaft.

25. The eccentric single-rotor screw pump according to claim 20, characterized in that the screw is made of rubber.

26. An eccentric single-rotor screw pump comprising:

a stator, an eccentric screw rotatably arranged within said stator, a propeller shaft connected with the eccentric screw; and a drive configured for causing a relative twisting between the eccentric screw and the stator, the eccentric screw rotating eccentrically, and wherein said propeller shaft has at least a flexible zone so that the propeller shaft is configured for transferring a rotational movement from the drive to the eccentric screw and thereby compensate a radial offset conditioned by an eccentric course of the eccentric screw, whereby the propeller shaft deforms, with the flexible zone comprising a steel rope wound in several layers.

27. The eccentric single-rotor screw pump according to claim 26, characterized in that the second screw has two end zones situated in an axial direction at opposite ends, a first of said end zones being connected with a first portion of a propeller shaft, via which a load is transferred from the drive to the eccentric screw, and a second of said end zones being connected with the eccentric screw, the first portion of the propeller shaft being arranged between the drive and the screw.

28. The eccentric single-rotor screw pump according to claim 26, characterized in that the propeller shaft has exactly one at least coherent element, which is configured flexible, whereby via said flexible element, a torque is transferrable from a drive to the eccentric screw.

29. The eccentric single-rotor screw pump according to claim 26, characterized in that the propeller shaft has a plurality of elements interconnected via rigid coupling, via which elements a torque is transferrable from a drive to the eccentric screw.

30. The eccentric single-rotor screw pump according to claim 26, characterized in that the propeller shaft has at least a flexible bearing, said bearing being flexible in the radial direction.

* * * * *